US007309216B1

(12) United States Patent
Spadola, Jr. et al.

(10) Patent No.: US 7,309,216 B1
(45) Date of Patent: Dec. 18, 2007

(54) PUMP CONTROL AND MANAGEMENT SYSTEM

(76) Inventors: Joseph Spadola, Jr., 354 Shaler Blvd., Ridgefield, NJ (US) 07657; Joseph R. Damianoe, 28 Robinson Ave., Glen Rock, NJ (US) 07452; Anthony Peluso, 825 Englemere Blvd., Toms River, NJ (US) 08757

( * ) Notice: Subject to any disclaimer, the term of this patent is extended or adjusted under 35 U.S.C. 154(b) by 735 days.

(21) Appl. No.: 10/764,392

(22) Filed: Jan. 23, 2004

(51) Int. Cl.
*F04B 49/00* (2006.01)

(52) U.S. Cl. ..... 417/18; 417/36; 417/53

(58) Field of Classification Search ..... 417/18, 417/36, 53, 63
See application file for complete search history.

(56) References Cited

U.S. PATENT DOCUMENTS 3,872,419 A 3/1975 Groves et al.
4,222,711 A 9/1980 Mayer
4,296,633 A * 10/1981 Hakansson et al. ..... 374/185
5,314,313 A 5/1994 Janesky
5,672,050 A * 9/1997 Webber et al. ..... 417/18
6,232,883 B1 5/2001 Silva et al.
6,364,620 B1 4/2002 Fletcher et al.
6,499,961 B1 * 12/2002 Wyatt et al. ..... 417/36
2003/0049134 A1 * 3/2003 Leighton et al. ..... 417/40

* cited by examiner

*Primary Examiner*—Anthony Stashick
*Assistant Examiner*—Vikansha Dwivedi
(74) *Attorney, Agent, or Firm*—Michael A. Blake

(57) ABSTRACT

A pump control and management system for monitoring and controlling sump pumps as well as providing supplemental controls and alarms. The pump control and management system includes a sump pump, a level sensing assembly, a control assembly, and at least one local sensor. The sump pump is designed for pumping water out of a sump pit. The level sensing assembly is preferably positioned within the sump pit for detecting a level of water in the sump pit. The control assembly is electrically coupled between an electrical service connection and the sump pump. The control assembly monitors electrical current drawn by the sump pump. The control assembly is also operationally coupled to the level sensing assembly. The control assembly activates the sump pump when the level sensing assembly signals that water in the sump pit has reached a predetermined level.

41 Claims, 9 Drawing Sheets

PUMP CONTROL AND MANAGEMENT SYSTEM

BACKGROUND OF THE INVENTION

1. Field of the Invention

The present invention relates to sump pumps and pump controls and more particularly pertains to a new pump control and management system for monitoring and controlling sump pumps as well as providing supplemental controls and alarms.

2. Description of the Prior Art

The use of sump pumps and pump controls is known in the prior art. Examples include U.S. Pat. No. 6,364,620; U.S. Pat. No. 6,232,883; U.S. Pat. No. 5,314,313; U.S. Pat. No. 3,872,419; and U.S. Pat. No. 4,222,711.

While these devices fulfill their respective, particular objectives and requirements, the need remains for a system that employs precise and reliable electronic level sensing and motor control and also provides periodic maintenance, pump monitoring, and auxiliary pumping capabilities.

SUMMARY OF THE INVENTION

The present invention meets the needs presented above by providing a comprehensive monitoring system which monitors current consumption, provides for periodic exercise of the pump even during dry periods, and a user reporting system for alerting a user to problems with the system.

One advantage to the present system is the ability to call out over conventional phone lines and alert someone at a remote location to a problem, even before damage may have occurred. For the purposes of this disclosure, conventional phone lines include at least paired wire land lines, cellular technologies, Voice over Internet Protocol (VoIP), and cable based telephone systems.

Another advantage of the present invention is the capability for auxiliary monitoring of other water or fluid related items such as water heaters, sinks, washing machines, pools, septic systems, boats, water pipes, and any unfriendly water in a predetermined area.

Yet another advantage of the present invention is the capability to use power line modulation to route signals between the control assembly, various sensors, and a conventional computer supplied by the user without the need for dedicated wiring for enhanced installation capabilities.

To this end, the present invention generally comprises a sump pump, a level sensing assembly, a control assembly, and at least one local sensor. The sump pump is designed for pumping water out of a sump pit. The level sensing assembly is preferably positioned within the sump pit for detecting a level of water in the sump pit. The control assembly is electrically coupled between an electrical service connection and the sump pump. The control assembly monitors electrical current drawn by the sump pump. The control assembly is also operationally coupled to the level sensing assembly. The control assembly activates the sump pump when the level sensing assembly signals that water in the sump pit has reached a predetermined level.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
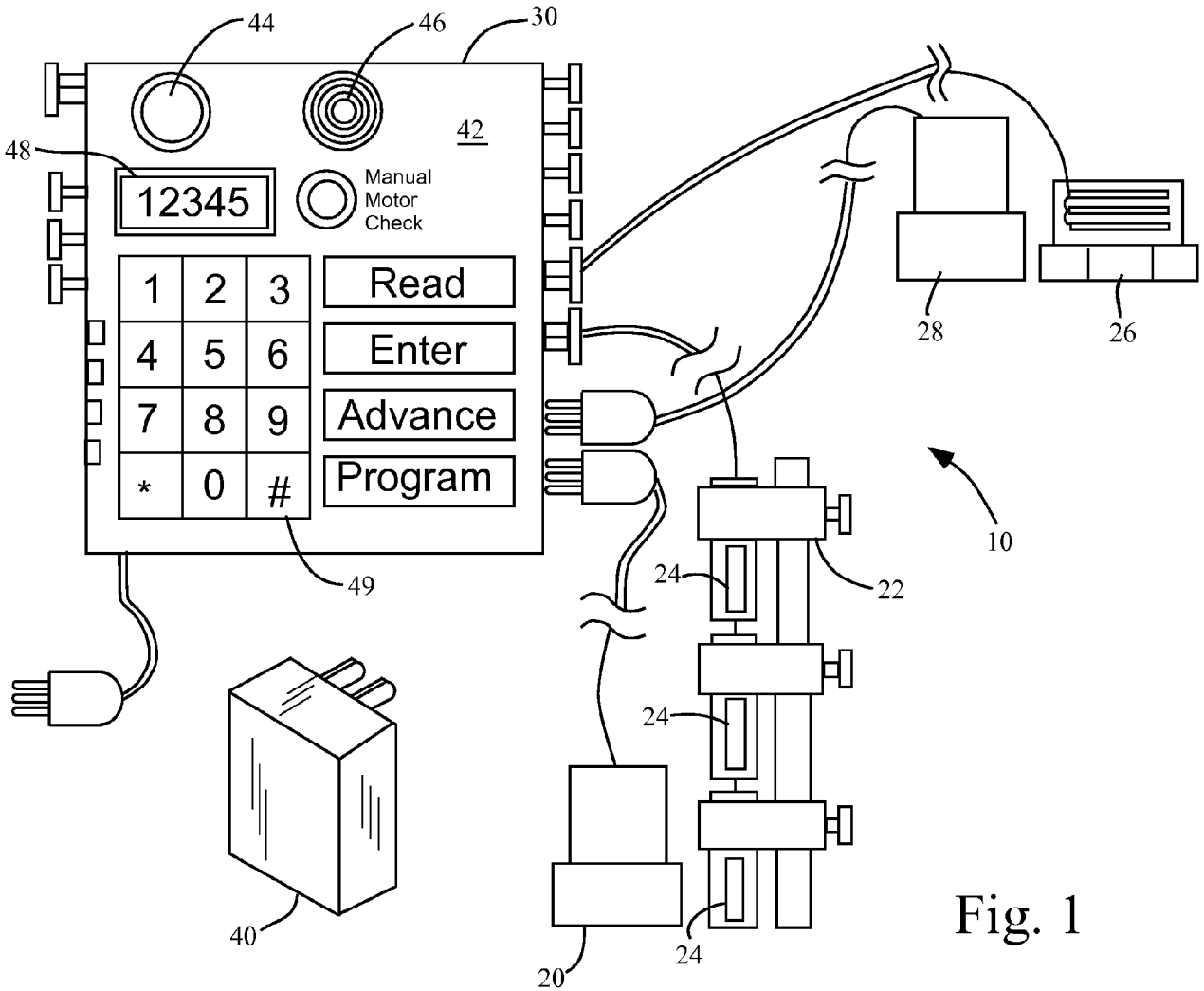
FIG. 1 is a schematic perspective view of a new pump control and management system according to the present invention.
Figure 2A:
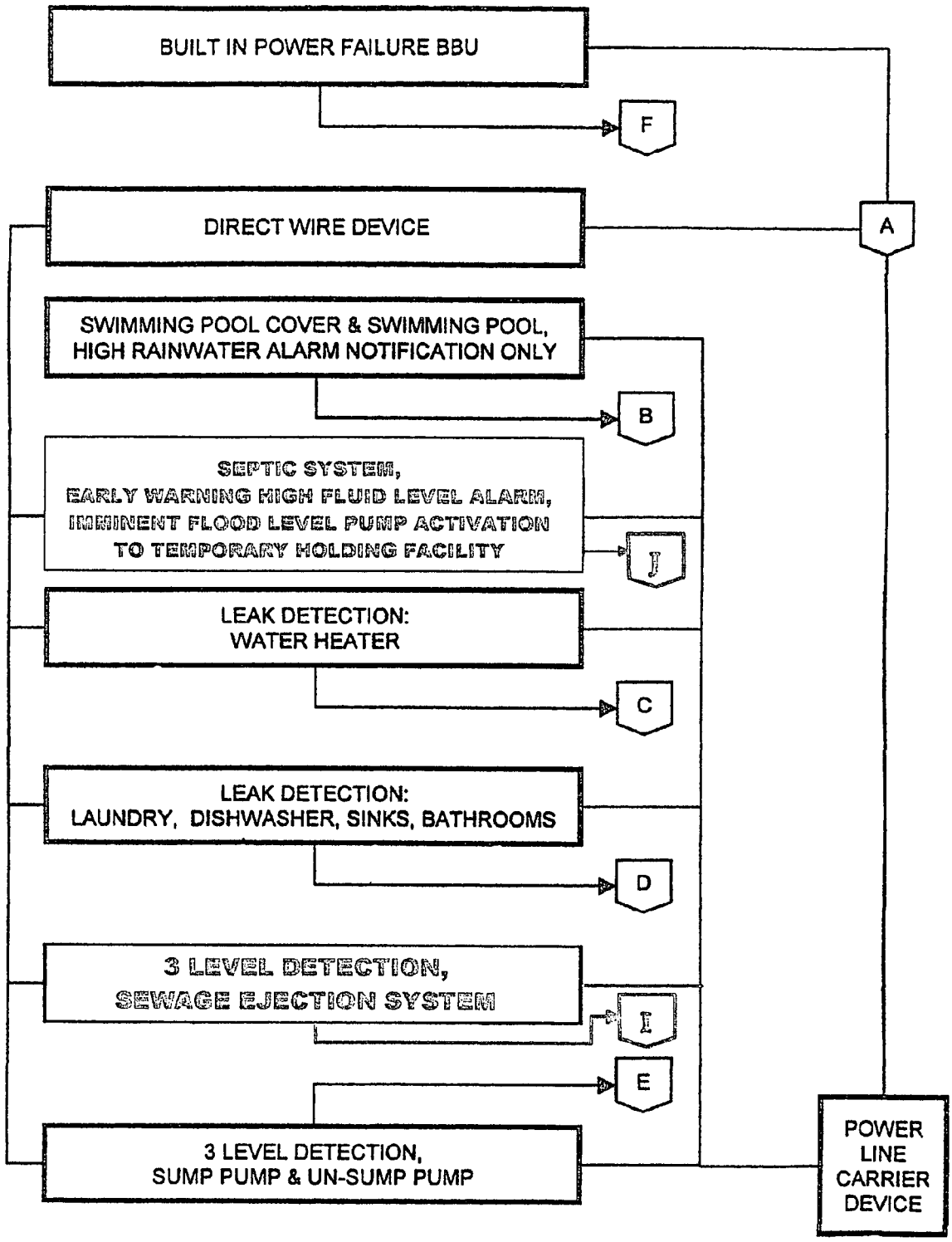
FIG. 2*a* is a partial block diagram of the present invention.
Figure 2B:
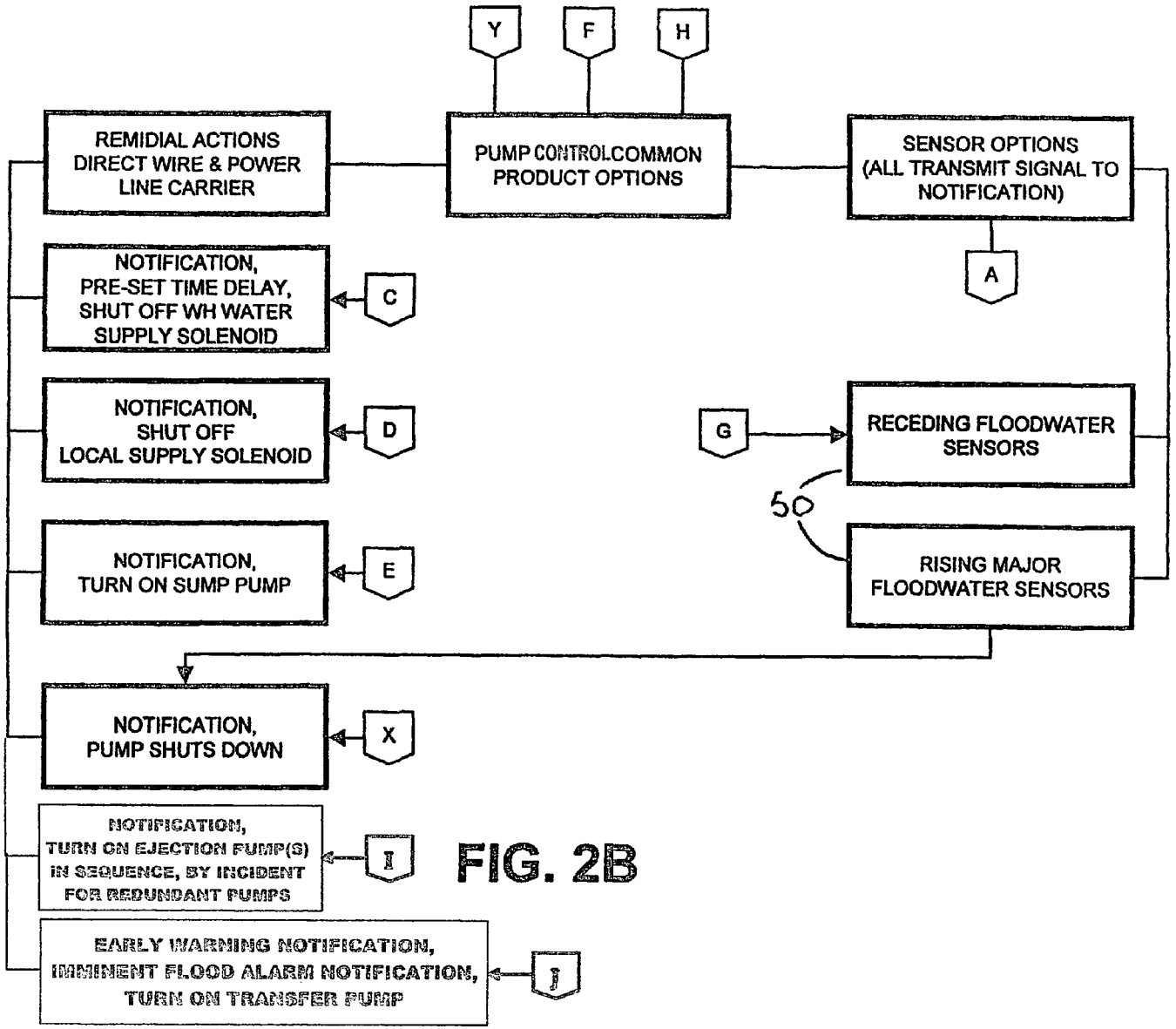
FIG. 2*b* is a partial block diagram of the present invention.
Figure 2C:
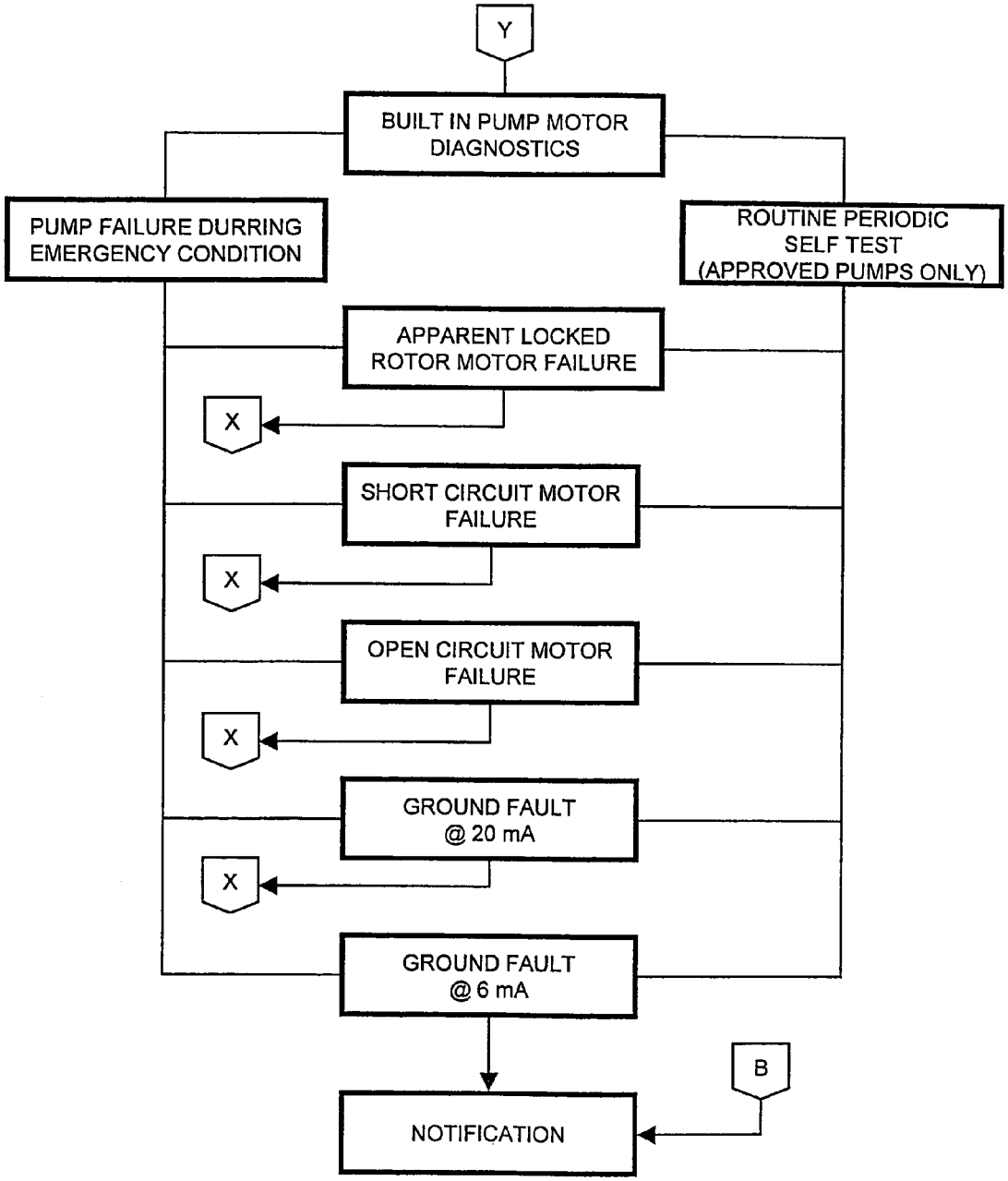
FIG. 2*c* is a partial block diagram of the present invention.
Figure 2D:
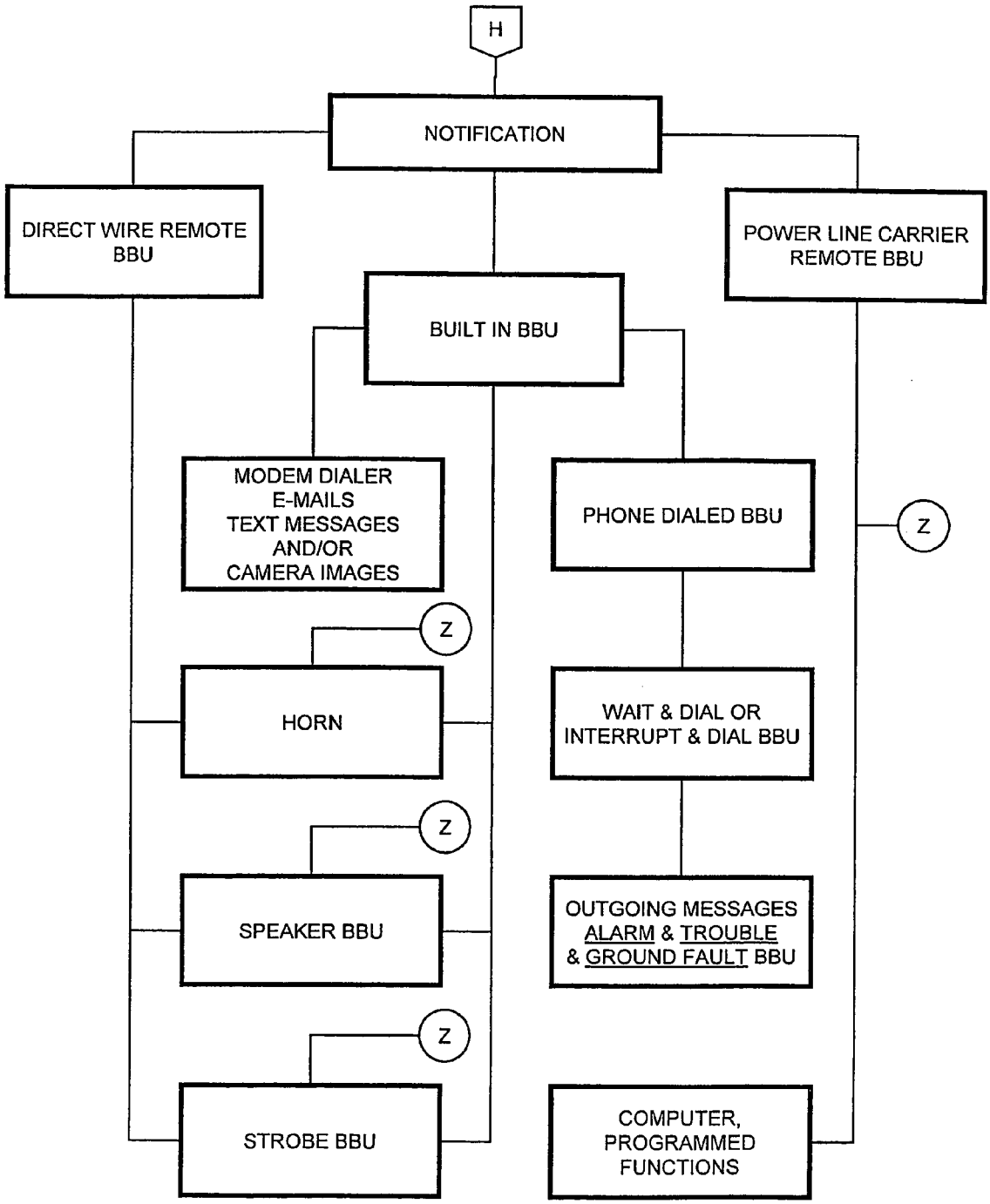
FIG. 2*d* is a partial block diagram of the present invention.
Figure 2E:
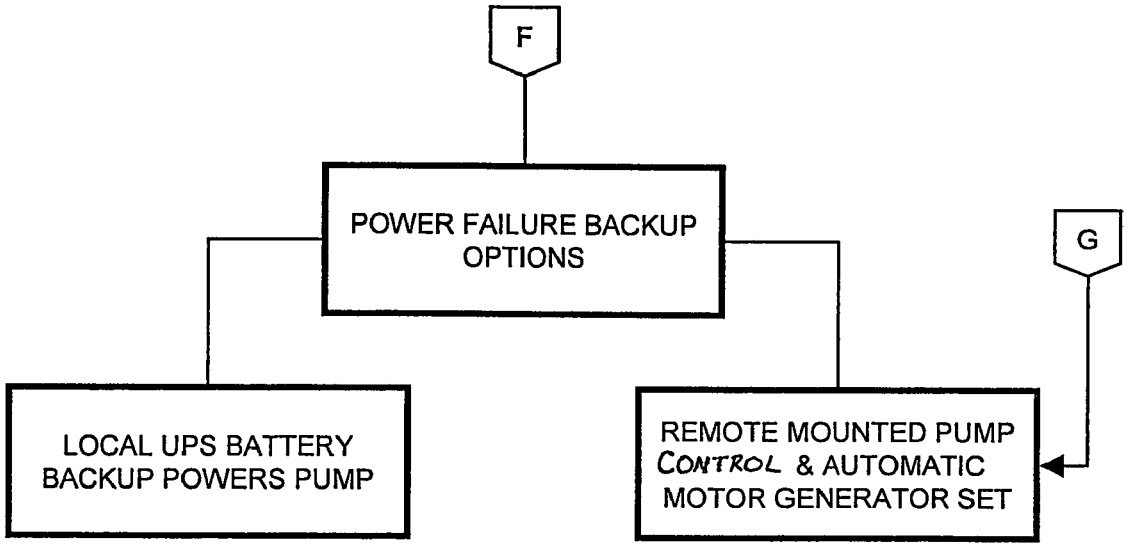
FIG. 2*e* is a partial block diagram of the present invention.

With reference now to the drawings, and in particular to FIGS. 1 through 5 thereof, a new pump control and management system embodying the principles and concepts of the present invention and generally designated by the reference numeral 10 will be described.

As best illustrated in FIGS. 1 through 5, the pump control and management system 10 generally comprises a sump pump 20, a level sensing assembly 22, a control assembly 30, and at least one local sensor 60.

The sump pump 20 is designed for pumping water out of a sump pit 2. The level sensing assembly 22 is preferably positioned within the sump pit 2 for detecting a level of water in the sump pit 2.

The control assembly 30 is electrically coupled between an electrical service connection and the sump pump 20. The control assembly 30 monitors electrical current drawn by the sump pump 20. The control assembly 30 is also operationally coupled to the level sensing assembly 22. The control assembly 30 activates the sump pump 20 when the level sensing assembly 22 signals that water in the sump pit 2 has reached a predetermined level. The control assembly 30 periodically performs diagnostic tests of the sump pump 20 to determine operability of the sump pump 20. The diagnostic tests include periodic activation of the sump pump 20 and monitoring of current drawing by the sump pump 20. When no current is drawn during a periodic activation an open motor or electrical connection failure may be indicated. If upon activation initial current consumption is high a potential binding of an impeller of the sump pump 20 may be indicated. If a continuous high current is detected a locked rotor may be indicated. The control assembly 30 provides a user alarm for each one of no current, initial high current, and continuous high current results of the diagnostic tests. The control assembly 30 may attempt to free the locked rotor by repeatedly applying electrical current to the sump pump 20 to jog the rotor a predetermined number of times. The control assembly 30 provides a user alarm if the attempt to free the locked rotor fails.

In a preferred embodiment the level sensing assembly 22 comprises a plurality of thermistors 24 positioned in the sump pit 2. Each one of the plurality of thermistors 24 changes resistance when in contact with water. Thus, the level of water in the sump pit 2 is determinable. Other types of level sensors may be used, however contact type sensors may not function properly with debris or contaminated water, and float type systems may stick and not operate properly, especially after prolonged dry periods.

In at least one embodiment, the control assembly 30 monitors the nominal operating condition of the level sensing assembly 22. Each one of the plurality of thermistors 24 has a nominal value of resistance for a dry condition and a second nominal value for a wet condition. Both nominal values have associated maximum and minimum values making up a tolerance around the nominal value. The control assembly 30 monitors the resistance value of each one of the plurality of thermistors 24. The monitoring may be continuous, periodic, or on a as requested basis. The control assembly 30 reports any out of tolerance conditions for any one of the plurality of thermistors 24 through a user alarm.

A local sensor 60 is used for detecting a water level outside of the sump pit 2. The local sensor 60 is also operationally coupled to the control assembly 30.

A secondary level detection assembly 26 for detecting water overflowing from the sump pit 2 may also be included. The secondary level detection assembly 26 is operationally coupled to the control assembly 30. A secondary pump 28 may operationally coupled to the control assembly 30, and activated when the secondary level detection assembly 26 detects a fluid above a predetermined secondary level.

In a further embodiment, the secondary level detection assembly 26 and secondary pump 28 may be employed as a primary pump system in situations not having the benefit of a sump pit 2. The secondary level detection assembly 26 and secondary pump 28 may be configured to operate automatically to remove unwanted fluid from a predetermined area.

A modem 32 may be operationally coupled to the control assembly 30. The modem 32 is couplable to a conventional telephone system, for dialing out on the conventional telephone system to relay an alarm condition from the control assembly 30 to a remote location.

A backup battery system 34 may be included for providing electrical power to the control assembly 30 and the modem 32 in the event of electrical failure. Thus, power failure and alarm conditions from the control assembly 30 may be relayed during power failure.

In an embodiment the modem 32 relays at least one of a plurality of predetermined voice messages associated with the alarm condition. Thus, a person listening at the remote location can determine the alarm condition.

In a further embodiment, the control assembly 30 further comprises a generator control assembly 36 for selectively signaling an electrical generator to start in the event of a power failure. The control assembly 30 is operationally coupled to an output of the generator for facilitating routing of electrical power from the electrical generator.

In yet a further embodiment the control assembly 30 may also include a computer interface 38 for operationally coupling the control assembly 30 to a conventional computer. Thus, data may be exchanged between the control assembly 30 and the conventional computer. If connected to a networked computer, data could be, selectively, shared over the network and can be password protected.

In still a further embodiment, the computer interface 38 further includes a power line modem 40 for routing data over existing in-situ power lines thereby decreasing a need for custom wiring of the system for installation. Similarly, power line modems 40 may be used with additional sensors and pumps to facilitate installation of the system.

In still yet a further embodiment, a flood detection assembly 50 may be operationally coupled to the control assembly 30. The flood detection assembly 50 detects rising flood waters and signals the control assembly 30. Additionally, the flood detection assembly 50 also detects receding flood water and signals the control assembly 30.

In even still a further embodiment, the control assembly 30 may be mounted in a remote location. The flood detection assembly 50, may be operationally coupled to the control assembly 30. The flood detection assembly may detect and monitor flood waters in terms of both an absolute level as well as a rate of change. The control assembly 30 could be operationally coupled to an electrical service associated with the structure for the purpose of selectively disconnecting service when flood waters reach a predetermined level. The predetermined level may be approximately equal to a height of the lowest electrical service connected device. Additionally, in the event that the monitored flood waters reach a pre-determined "hopeless" level the control assembly could conserve fuel and mechanical resources by shutting down any pumping and generating activities to conserve generator fuel when the water is rising at a rate calculated to be far greater than the capacity of the pump. Further, the flood detection assembly 50 may also detect receding flood water and signal the control assembly 30 to resume all appropriate pumping and generating activities at the predetermined level or rate where pumping is expected to once again become practical.

An information display panel 42 may be operationally coupled to the control assembly 30. The information display panel 42 may include a strobe light 44 for providing a visual indication of an alarm condition, a speaker 46 for providing an aural indication of an alarm condition, a display output 48 for providing a visual representation of an system status and alarm condition, and a keyboard assembly 49 for facilitating data input into the system by a user.

In a further embodiment, the system may include a sewage ejector interface system 52 with a sewage level detection assembly 56 operationally coupled to the control assembly 30. The sewage level detection assembly 56 indicates at least a detection of a fluid at a pump stop level, detection of a fluid at a pump start level, and a high level alarm detection. The sewage ejector interface system 52 preferably includes at least one sewage ejector pump interface 54 for selectively controlling operation of a sewage ejection pump.

A plurality of local sensors 60 may be operationally coupled to the control assembly 30. The plurality of local sensors 60 may include: a water heater leak sensor 61 for sensing a leak from a conventional water heater, a laundry leak sensor 62 for sensing a leak from a conventional washing machine, a dishwasher leak sensor 63 for sensing a leak from a conventional dishwasher, a sink leak detector 64 for sensing a leak from a conventional sink, a bathroom leak detector 65 for sensing a water leak in a bathroom, a pool sensor 66 for detecting a high water level in pool, and a septic system sensor 67 for detecting a high level in a septic system. The control assembly 30 may generate an alarm uniquely associated with each one of the sensors. Additionally, the control assembly 30 may activate a solenoid 68 to shut off a water supply when the alarm is generated.

In at least one embodiment, the control assembly 30 may also monitor the nominal operating condition of each one of the local sensors 60, the secondary level detection assembly 26, the flood detection assembly 50, and the sewage level detection assembly 56. As with monitoring the level sensing assembly 22, each one of the local sensors, 60, the secondary level detection assembly 26, the flood detection assembly 50, and the sewage level detection assembly 56 utilize a plurality of thermistors. Each one of these thermistors has a nominal value of resistance for a dry condition and a second nominal value for a wet condition. Both nominal values have associated maximum and minimum values making up a tolerance around the nominal value. The control assembly 30 monitors the resistance value of each one of the plurality of thermistors for each one of the local sensors 60, the secondary level detection assembly 26, the flood detection assembly 50, and the sewage level detection assembly 56. The monitoring may be continuous, periodic, or on a as requested basis. The control assembly 30 reports any out of tolerance conditions for any one of the plurality of thermistors through a user alarm.

In an embodiment, the system includes a manual pump actuation assembly 70, which provides a user with a means of actuating the sump pump 20 on demand. The manual pump actuation assembly 70 is operationally coupled to the control assembly 30.

In even still a further embodiment, the system includes at least one video camera 72 operationally coupled to the control assembly 30. Upon an alarm condition or when requested by a user, the system 10 can provide a video image of an area being monitored by the video camera 72. The modem 32 may relay at least one video image associated with the alarm condition. Thus, a person monitoring at the remote location can visually determine the severity of the situation associated with the alarm condition.

In still yet a further embodiment, a captured view of the video camera(s) 72 may be adjusted by the control assembly 30 by either zooming, tilting or panning the camera 72 to change an area of monitoring when commanded by the control assembly 30. The control assembly 30 may receive instructions from a remote user via the modem 32. Thus the positioning of the video camera(s) 72 is controllable by a remote user.

A video motion detector 73 may be operationally coupled to the video camera(s) 72 to determine an occurrence of motion based upon a video image from the video camera(s) 72. Further, the system may include a video motion filter 74 capable of selecting a sub-area of the video image for determining the occurrence of motion, and selecting a threshold of motion necessary to generate a supplemental signal indicating the occurrence of motion.

Figure 3:
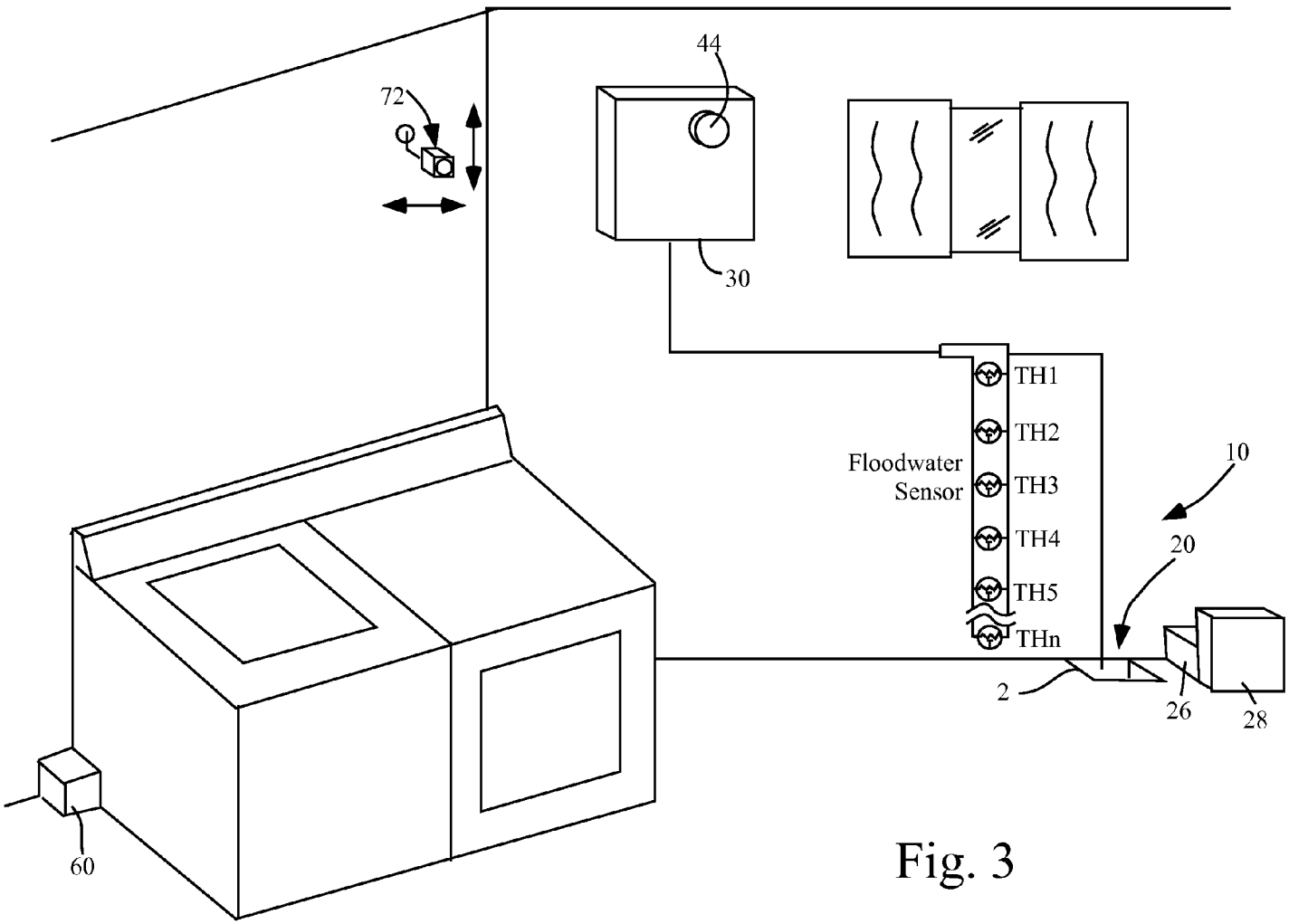
FIG. 3 is a schematic perspective view of the present invention in use in a normal condition.
Figure 4:
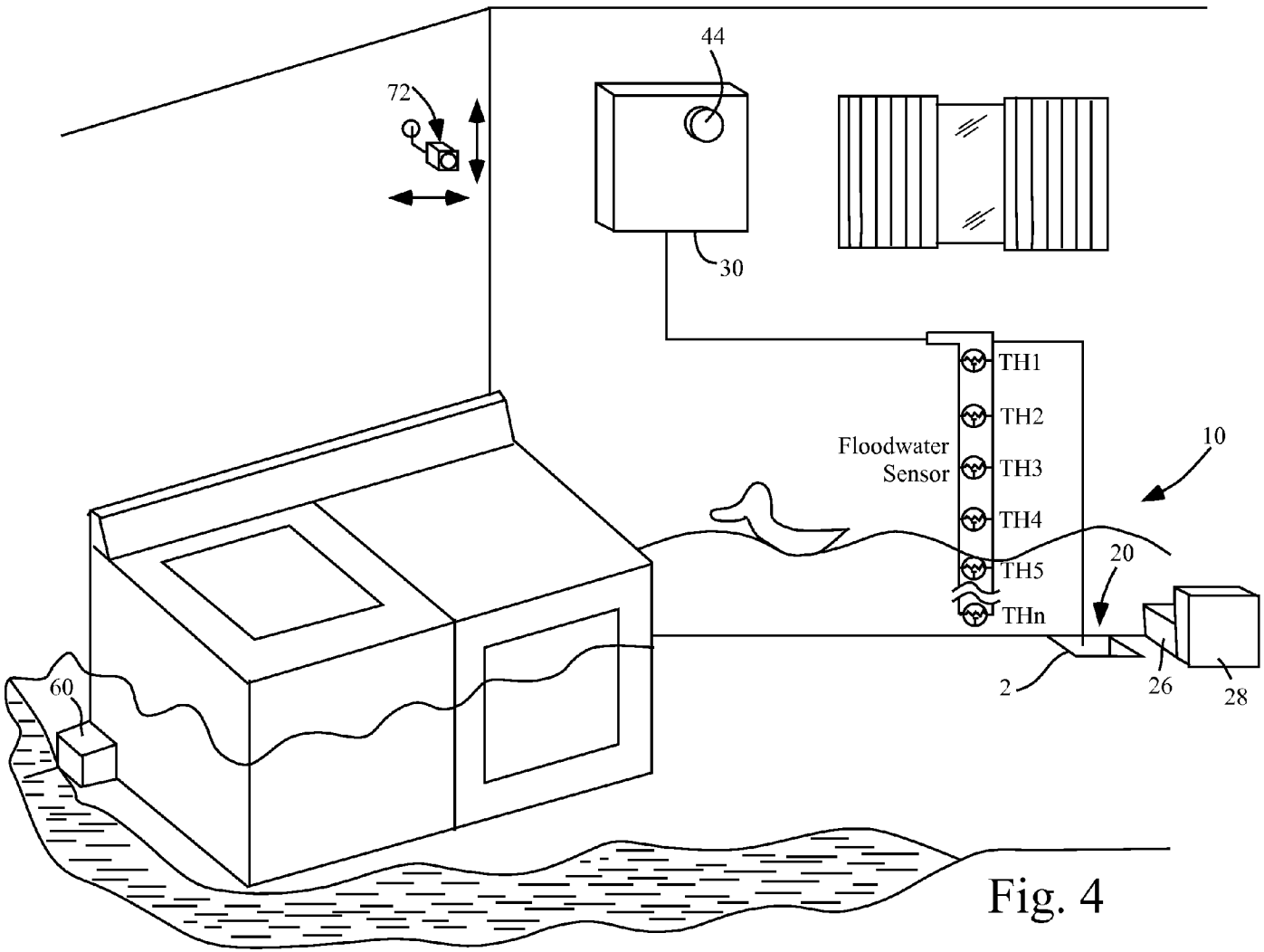
FIG. 4 is a schematic perspective view of the present invention in use in an alarm condition.
Figure 5:
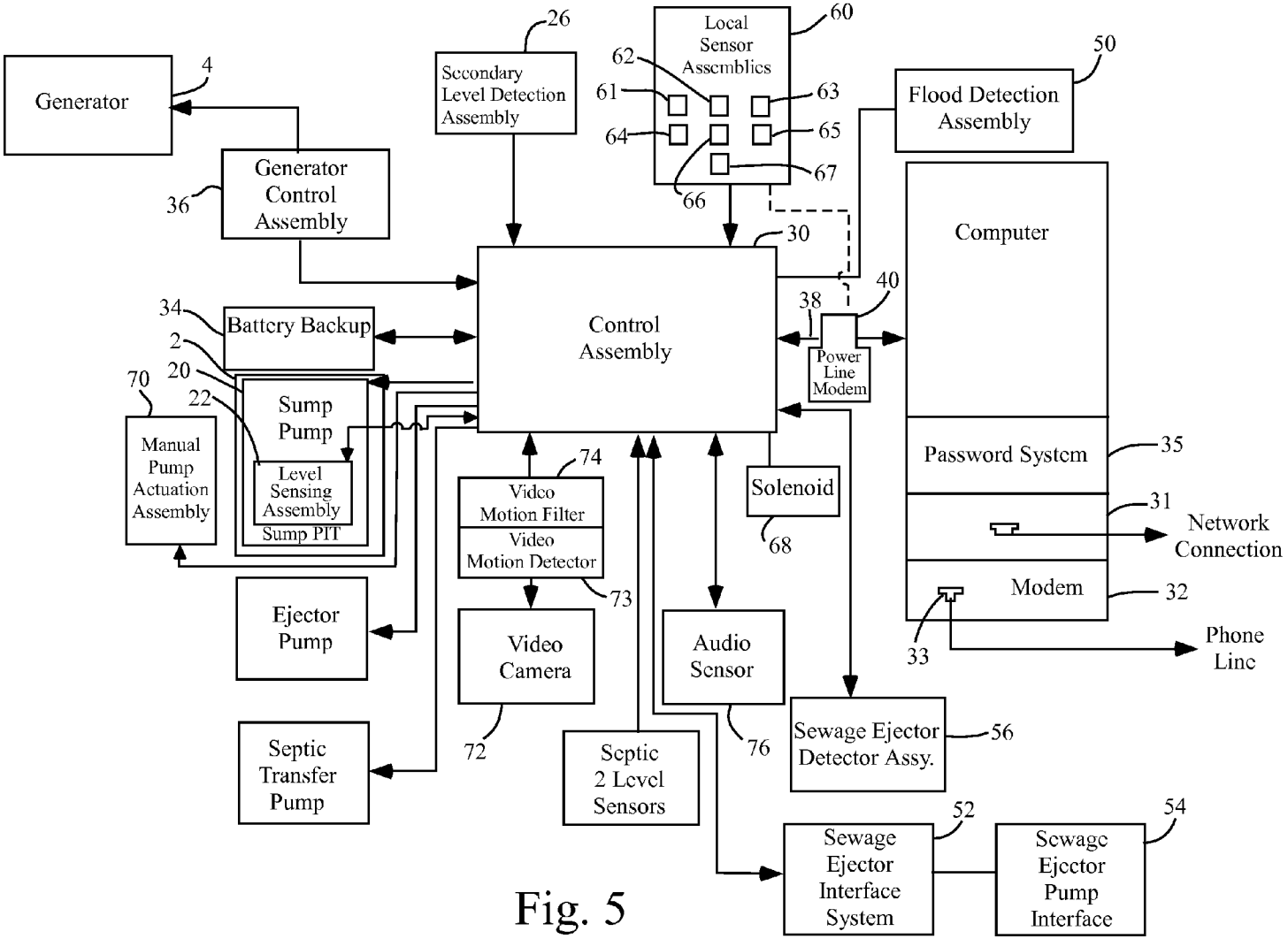
FIG. 5 is a schematic functional interconnect diagram of the present invention.

As an illustrative example of this type of detection and filtering, FIG. 3 shows a typical laundry room being monitored by the system 10. The video motion detector 73 and the video motion filter 74 allow the system to operate without an alarm condition for normal movement of the drapes as shown. However, FIG. 4, shows that when abnormal or unexpected movement occurs, the system 10 enters an alarm condition.

Further, at least one audio transducer 76 for selectively capturing ambient audio in an area to be monitored may be operationally coupled to the control assembly 30 for providing a representation of the ambient audio to a user.

Most preferably, the control assembly 30 is remotely accessible by a remote user through a remote connection means at any time. Thus, the system 10 may be controlled by the remote user. The remote connection means may be a dial-up connection 33 operationally interacting with said modem 32, an internet protocol (IP) address 31, or other suitable connection method. A password system 35 may be used for inhibiting unauthorized access to the control assembly 30 through the remote connection means.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A pump control and management system comprising:

a sump pump adapted for pumping water out of a sump pit;

a level sensing assembly positioned within the sump pit for detecting a level of water in the sump pit, and a control assembly operationally coupled to said sump pump, said control assembly being operationally coupled to said level sensing assembly, said control assembly activating said sump pump when said level sensing assembly signals that water in the sump pit has reached a predetermined level; and wherein said control assembly periodically performs diagnostic tests of said sump pump to determine operability of said sump pump, said diagnostic tests includes periodic activation of said sump pump and monitoring of current drawing by said sump pump, no current being drawn indicating an open motor or electrical connection failure, initial high current consumption indicating potential binding of an impeller of said sump pump, continuous high current indicating a locked rotor, said control assembly providing a user alarm for each one of no current, initial high current, and continuous high current results of said diagnostic tests.

2. The system of claim 1, wherein said control assembly being electrically coupled between an electrical service connection and said sump pump, said control assembly monitoring electrical current drawn by said sump pump.

3. The system of claim 2, wherein said control assembly detects a locked rotor of said sump pump when the electrical current drawn from the electrical service connection exceeds a predetermined threshold, said control assembly attempts to free the locked rotor by repeatedly applying electrical current to said sump pump to jog the rotor a predetermined number of times, said control assembly providing a user alarm if the attempt to free the locked rotor fails.

4. The system of claim 1, wherein said level sensing assembly comprises a plurality of thermistors positioned in the sump pit, each one of said plurality of thermistors changing resistance when in contact with water whereby the level of water in the sump pit is determinable.

5. The system of claim 4, wherein said control assembly monitors a resistance value associated with each one of said plurality of thermistors, said control assembly providing a user alarm upon any one of said plurality of thermistors having a resistance value outside of a predetermined range.

6. The system of claim 1, further comprising at least one local sensor for detecting a water level outside of the sump pit, said local sensor being operationally coupled to said control assembly.

7. The system of claim 6, wherein said control assembly monitors a resistance value associated with said at least one local sensor, said control assembly providing a user alarm upon any one of said at least one local sensor having a resistance value outside of a predetermined range.

8. A pump control and management system comprising:

a sump pump adapted for pumping water out of a sump pit;

a level sensing assembly positioned within the sump pit for detecting a level of water in the sump pit; and a control assembly being electrically coupled between an electrical service connection and said sump pump, said control assembly monitoring electrical current drawn by said sump pump, said control assembly being operationally coupled to said level sensing assembly, said control assembly activating said sump pump when said level sensing assembly signals that water in the sump pit has reached a predetermined level, said control assembly periodically performs diagnostic tests of said sump pump to determine operability of said sump pump, said diagnostic tests includes periodic activation of said sump pump and monitoring of current drawing by said sump pump, no current being drawn indicating an open motor or electrical connection failure, initial high current consumption indicating potential binding of an impeller of said sump pump, continuous high current indicating a locked rotor, said control assembly providing a user alarm for each one of no current, initial high current, and continuous high current results of said diagnostic tests, said control assembly attempts to free the locked rotor by repeatedly applying electrical current to said sump pump to jog the rotor a predetermined number of times, said control assembly providing a user alarm if the attempt to free the locked rotor fails;

wherein said level sensing assembly comprises a plurality of thermistors positioned in the sump pit, each one of said plurality of thermistors changing resistance when in contact with water whereby the level of water in the sump pit is determinable;

at least one local sensor for detecting a water level outside of the sump pit, said local sensor being operationally coupled to said control assembly; and an information display panel operationally coupled to said control assembly, said information display panel including a strobe light for providing a visual indication of an alarm condition, said information display panel including a speaker for providing an aural indication of an alarm condition, said information display panel including a display output for providing a visual representation of an system status and alarm condition, said information display panel including a keyboard assembly for facilitating data input into said system by a user.

9. The system of claim 8, further comprising:

a sewage ejector interface system operationally coupled to said control assembly;

a sewage level detection assembly operationally coupled to said control assembly, said sewage level detection assembly indicating at least a stop level detection, a start level detection, and a high level alarm detection; and a sewage ejector pump interface for selectively controlling operation of a sewage ejection pump, said sewage ejector pump interface operationally coupled to said sewage ejector interface system.

10. The system of claim 9, wherein said control assembly monitors a resistance value associated with said sewage level detection assembly, said control assembly providing a user alarm upon said sewage level detection assembly having a resistance value outside of a predetermined range.

11. The system of claim 8, further comprising:

a water heater leak sensor operationally coupled to said control assembly for sensing a leak from a conventional water heater;

a laundry heater sensor operationally coupled to said control assembly for sensing a leak from a conventional washing machine;

a dishwasher leak sensor operationally coupled to said control assembly for sensing a leak from a conventional dishwasher;

a sink leak detector operationally coupled to said control assembly for sensing a leak from a conventional sink;

a bathroom leak detector operationally coupled to said control assembly for sensing a water leak in a bathroom;

a pool sensor operationally coupled to said control assembly for detecting a high water level in pool;

a septic system sensor operationally coupled to said control assembly for detecting a high level in a septic system;

said control assembly generating an alarm uniquely associated with each one of said water heater leak sensor, said laundry leak sensor, said a dishwasher leak sensor, said sink leak detector, said bathroom leak detector, said pool sensor, and said septic system sensor, said control assembly activating a solenoid to shut off a water supply when said alarm is generated.

12. The system of claim 8 wherein said control assembly monitors a resistance value associated with each one of said at least one local sensor, said control assembly providing a user alarm upon any one of said at least one local sensor having a resistance value outside of a predetermined range.

13. The system of claim 8 further comprising a manual pump actuation assembly for providing a user with a means of actuating said sump pump on demand, said manual pump actuation assembly being operationally coupled to said control assembly.

14. The system of claim 8, further comprising a motion detector operationally coupled to said control assembly.

15. The system of claim 14, wherein said motion detection means further comprises:

at least one video camera being adjustable by said control assembly, said video camera tilting to change an area of monitoring when commanded by said control assembly, said video camera being panning when commanded by said control assembly to change an area of monitoring;

a video motion detector operationally coupled to said at least one video camera to determine an occurrence of motion based upon a video image from said at least one video camera.

16. The system of claim 15, wherein said motion detection means further comprises a video motion filter, said filter being capable of selecting a sub-area of said video image for determining the occurrence of motion, said filter being capable of selecting a threshold of motion necessary to generate said supplemental signal.

17. The system of claim 8, further comprising at least one audio transducer for selectively capturing ambient audio in an area to be monitored, said at least one audio transducer being operationally coupled to said control assembly for providing a representation of the ambient audio to a user.

18. The system of claim 8, wherein said control assembly being remotely accessible by a remote user whereby said system may be controlled by the remote user.

19. The system of claim 18, wherein said control assembly being remotely accessible by the remote user through a dial-up connection operationally interacting with said modem, whereby the remote user may dial a telephone number associated with said modem and interact with said control assembly.

20. The system of claim 19, further comprising a password system for inhibiting unauthorized access to said control assembly through said dial-up connection.

21. The system of claim 18, wherein said control assembly being operationally coupled to an internet whereby said control assembly is accessible through an internet protocol (IP) address, whereby the remote user may access an internet page and interact with said control assembly.

22. The system of claim 21, further comprising a password system for inhibiting unauthorized access to said control assembly through said internet protocol (IP) address.

23. The system of claim 8, further comprising:

a secondary level detection assembly, for detecting water overflowing from the sump pit, said secondary level detection assembly being operationally coupled to said control assembly; and a secondary pump operationally coupled to said control assembly, said secondary pump being activated when said secondary level detection assembly detects a fluid above a predetermined secondary level.

24. The system of claim 23, wherein said control assembly monitors a resistance value associated with said secondary level detection assembly, said control assembly providing a user alarm upon said secondary level detection assembly having a resistance value outside of a predetermined range.

25. The system of claim 8, further comprising a modem operationally coupled to said control assembly, said modem being coupleable to a conventional telephone system, said modem being for dialing out on the conventional telephone system to relay an alarm condition from said control assembly to a remote location.

26. The system of claim 25, further comprising a backup battery system for providing electrical power to said control assembly and said modem in the event of electrical failure whereby said alarm condition from said control assembly may be relayed during power failure.

27. The system of claim 25, wherein said modem relays at least one of a plurality of predetermined voice messages associated with said alarm condition whereby a person listening at the remote location can determine the alarm condition.

28. The system of claim 25, further comprising at least one video camera operationally coupled to said control assembly, said video camera monitoring an area associated with said at least one local sensor, said video camera providing at least one image to be relayed through said modem to a remote location upon generation of an alarm associated with one of said sensors.

29. The system of claim 28, wherein a position of said at least one video camera is adjustable by said control assembly, said video camera tilting to change an area of monitoring when commanded by said control assembly, said video camera panning when commanded by said control assembly to change an area of monitoring.

30. The system of claim 29, wherein said control assembly commanding said at least one video camera to tilt upon receiving an instruction from a remote user via said modem and said control assembly commanding said at least one video camera to pan upon receiving an instruction from a remote user via said modem whereby positioning of said at least one video camera is controllable by a remote user.

31. The system of claim 8, wherein said control assembly further comprises a generator control assembly for selectively signaling an electrical generator to start in the event of a power failure, said control assembly being operationally coupled to an output of the generator for facilitating routing of electrical power from the electrical generator.

32. The system of claim 8, wherein said control assembly further comprises a computer interface for operationally coupling said control assembly to a conventional computer whereby data may be exchanged between said control assembly and the conventional computer.

33. The system of claim 32, wherein said computer interface further includes a power line modem for routing data over existing in situ power lines thereby decreasing a need for custom wiring of the system for installation.

34. The system of claim 8, further comprising a flood detection assembly operationally coupled to said control assembly, said flood detection assembly detecting rising flood waters and signaling said control assembly, said flood detection assembly detecting receding flood water and signaling said control assembly.

35. A pump control and management system comprising:

a sump pump adapted for pumping water out of a sump pit;

a level sensing assembly positioned within the sump pit for detecting a level of water in the sump pit; and a control assembly being electrically coupled between an electrical service connection and said sump pump, said control assembly monitoring electrical current drawn by said sump pump, said control assembly being operationally coupled to said level sensing assembly, said control assembly activating said sump pump when said level sensing assembly signals that water in the sump pit has reached a predetermined level, said control assembly periodically performs diagnostic tests of said sump pump to determine operability of said sump pump, said diagnostic tests includes periodic activation of said sump pump and monitoring of current drawing by said sump pump, no current being drawn indicating an open motor or electrical connection failure, initial high current consumption indicating potential binding of an impeller of said sump pump, continuous high current indicating a locked rotor, said control assembly providing a user alarm for each one of no current, initial high current, and continuous high current results of said diagnostic tests, said control assembly attempts to free the locked rotor by repeatedly applying electrical current to said sump pump to jog the rotor a predetermined number of times, said control assembly providing a user alarm if the attempt to free the locked rotor fails;

wherein said level sensing assembly comprises a plurality of thermistors positioned in the sump pit, each one of said plurality of thermistors changing resistance when in contact with water whereby the level of water in the sump pit is determinable;

at least one local sensor for detecting a water level outside of the sump pit, said local sensor being operationally coupled to said control assembly;

a secondary level detection assembly for detecting water overflowing from the sump pit, said secondary level detection assembly being operationally coupled to said control assembly; and a secondary pump operationally coupled to said control assembly, said secondary pump being activated when said secondary level detection assembly detects a fluid above a predetermined secondary level;

a modem operationally coupled to said control assembly, said modem being coupleable to a conventional telephone system, said modem being for dialing out on the conventional telephone system to relay an alarm condition from said control assembly to a remote location;

a backup battery system for providing electrical power to said control assembly and said modem in the event of electrical failure whereby said alarm condition from said control assembly may be relayed during power failure;

wherein said modem relays at least one of a plurality of predetermined voice messages associated with said alarm condition whereby a person listening at the remote location can determine the alarm condition;

said control assembly further comprises a generator control assembly for selectively signaling an electrical generator to start in the event of a power failure, said control assembly being operationally coupled to an output of the generator for facilitating routing of electrical power from the electrical generator;

said control assembly further comprises a computer interface for operationally coupling said control assembly to a conventional computer whereby data may be exchanged between said control assembly and the conventional computer;

said computer interface further includes a power line modem for routing data over existing in-situ power lines thereby decreasing a need for custom wiring of the system for installation;

a flood detection assembly operationally coupled to said control assembly, said flood detection assembly detecting rising flood waters and signaling said control assembly, said flood detection assembly detecting receding flood water and signaling said control assembly;

an information display panel operationally coupled to said control assembly, said information display panel including a strobe light for providing a visual indication of an alarm condition, said information display panel including a speaker for providing an aural indication of an alarm condition, said information display panel including a display output for providing a visual representation of an system status and alarm condition, said information display panel including a keyboard assembly for facilitating data input into said system by a user;

a sewage ejector interface system including a sewage level detection assembly operationally coupled to said control assembly, said sewage level detection assembly indicating at least a stop level detection, a start level detection, and a high level alarm detection, said sewage ejector interface system including at least one sewage ejector pump interface for selectively controlling operation of a sewage ejection pump; and a manual pump actuation assembly for providing a user with a means of actuating said sump pump on demand, said manual pump actuation assembly being operationally coupled to said control assembly.

36. The system of claim 35, further comprising:

at least one video camera operationally coupled to said control assembly, said video camera monitoring an area associated with at least one of said sensors, said video camera providing at least one image to be relayed through said modem to a remote location upon generation of an alarm associated with one of said sensors;

wherein a position of said at least one video camera being adjustable by said control assembly, said video camera tilting to change an area of monitoring when commanded by said control assembly, said video camera being panning when commanded by said control assembly to change an area of monitoring;

said control assembly commanding said at least one video camera to tilt upon receiving an instruction from a remote user via said modem and said control assembly commanding said at least one video camera to pan upon receiving an instruction from a remote user via said modem whereby positioning of said at least one video camera is controllable by a remote user;

a video motion detector operationally coupled to said at least one video camera to determine an occurrence of motion based upon a video image from said at least one video camera; and a video motion filter being capable of selecting a sub-area of said video image for determining the occurrence of motion, said filter being capable of selecting a threshold of motion necessary to generate a supplemental signal.

37. The system of claim 35, further comprising at least one audio transducer for selectively capturing ambient audio in an area to be monitored, said at least one audio transducer being operationally coupled to said control assembly for providing a representation of the ambient audio to a user.

38. The system of claim 35, further comprising:

said control assembly being remotely accessible by the remote user through a dial-up connection operationally interacting with said modem, whereby the remote user may dial a telephone number associated with said modem and interact with said control assembly; and a password system for inhibiting unauthorized access to said control assembly through said dial-up connection.

39. The system of claim 35 further comprising:

wherein said control assembly being remotely accessibly by a remote user through a remote connection means whereby said system may be controlled by the remote user;

said remote connection means being selected from the group of remote connection means consisting of a dial up connection operationally interacting with said modem, and an internet protocol (IP) address; and a password system for inhibiting unauthorized access to said control assembly through said remote connection means.

40. The system of claim 35, further comprising:

at least one video camera operationally coupled to said control assembly, said video camera monitoring area associated with at least one of said sensors, said video camera providing at least one image to be relayed through said modem to a remote location upon generation of an alarm associated with one of said sensors;

wherein a position of said at least one video camera being adjustable by said control assembly, said video camera tilting to change an area of monitoring when commanded by said control assembly, said video camera being panning when commanded by said control assembly to change an area of monitoring;

said control assembly commanding said at least one video camera to tilt upon receiving an instruction from a remote user via said modem and said control assembly commanding said at least one video camera to pan up on receiving an instruction from a remote user via said modem whereby positioning of said at least one video camera is controllable by a remote user;

a video motion detector operationally coupled to said at least one video camera to determine an occurrence of motion based upon a video image from said at least one video camera;

a video motion filter being capable of selecting a sub-area of said video image for determining the occurrence of motion, said filter being capable of selecting a threshold of motion necessary to generate a supplemental signal;

at least one audio transducer for selectively capturing ambient audio in an area to be monitored, said at least one audio transducer being operationally coupled to said control assembly for providing a representation of the ambient audio to a user;

wherein said control assembly being remotely accessible by a remote user through a remote connection means whereby said system may be controlled by the remote user;

said remote connection means being selected from the group of remote connection means consisting of a dial-up connection operationally interacting with said modem, and an internet protocol (IP) address; and a password system for inhibiting unauthorized access to said control assembly through said remote connection means.

41. The system of claim 35, further comprising:

wherein said control assembly monitors a resistance value associated with each one of said level sensing assembly, said at least one local sensor, said secondary level detection assembly, said sewage level detection assembly, and said flood detection assembly;

said control assembly providing a user alarm upon any one of said plurality of said level sensing assembly, said at least one local sensor, said secondary level detection assembly, said sewage level detection assembly, and said flood detection assembly having a resistance value outside of a predetermined range.

* * * * *